US012366037B2

(12) United States Patent
Kanamaru

(10) Patent No.: US 12,366,037 B2
(45) Date of Patent: Jul. 22, 2025

(54) WATER DISPERSIBLE SHEET AND METHOD TO MANUFACTURE WATER DISPERSIBLE SHEET

(71) Applicant: DAIO PAPER CORPORATION, Shikokuchuo (JP)

(72) Inventor: Kaori Kanamaru, Shikokuchuo (JP)

(73) Assignee: DAIO PAPER CORPORATION, Shikokuchuo (JP)

( * ) Notice: Subject to any disclaimer, the term of this patent is extended or adjusted under 35 U.S.C. 154(b) by 217 days.

(21) Appl. No.: 17/924,026

(22) PCT Filed: May 11, 2021

(86) PCT No.: PCT/JP2021/017882
§ 371 (c)(1),
(2) Date: Nov. 8, 2022

(87) PCT Pub. No.: WO2021/241205
PCT Pub. Date: Dec. 2, 2021

(65) Prior Publication Data

US 2023/0167608 A1 Jun. 1, 2023

(30) Foreign Application Priority Data

May 29, 2020 (JP) ..... 2020-094077

(51) Int. Cl.
*D21H 17/06* (2006.01)
*A47L 13/17* (2006.01)
(Continued)

(52) U.S. Cl.
CPC ..... *D21H 17/06* (2013.01); *A47L 13/17* (2013.01); *D21H 25/005* (2013.01); *D21H 25/02* (2013.01); *D21H 25/04* (2013.01)

(58) Field of Classification Search
CPC ..... D21H 17/06; D21H 25/005; D21H 25/02; D21H 25/04; D21H 27/002; D21H 11/18;
(Continued)

(56) References Cited

U.S. PATENT DOCUMENTS 8,834,677 B2 * 9/2014 Tirimacco ..... D21H 27/002 162/168.3
9,279,219 B2 * 3/2016 Edwards ..... D21H 27/007
(Continued)

FOREIGN PATENT DOCUMENTS

EP 0372388 A2 * 6/1990 ..... D21H 17/43
EP 3305158 A1 4/2018
(Continued)

OTHER PUBLICATIONS

Machine Translation of JP 2008002017 A. (Year: 2008).*
(Continued)

*Primary Examiner* — Jose A Fortuna
(74) *Attorney, Agent, or Firm* — Maier & Maier, PLLC

(57) ABSTRACT

A water dispersible sheet includes a base paper sheet including a water dispersible fiber aggregate. The base paper sheet is impregnated with a chemical solution. The fiber aggregate includes 50% by mass to 70% by mass of NBKP. The water dispersible sheet includes a longitudinal/transverse strength ratio of 0.9 to 1.2. Emboss is formed on the water dispersible sheet.

5 Claims, 4 Drawing Sheets

(51) Int. Cl.
*D21H 25/00* (2006.01)
*D21H 25/02* (2006.01)
*D21H 25/04* (2006.01)

(58) Field of Classification Search
CPC ..... D21H 27/30; D21H 19/34; D21H 27/00; D21H 21/22; D21H 17/15; D21H 21/18; D21H 21/20; D21H 27/40; A47L 13/17; A47L 13/16; A47K 11/10; A47K 11/105; A47K 10/16; D04H 1/26; D04H 1/28; D04H 1/492
See application file for complete search history.

(56) References Cited

U.S. PATENT DOCUMENTS

| | | | | |
|---|---|---|---|---|
| 10,323,354 | B2 * | 6/2019 | Kawahara | D21H 17/46 |
| 11,395,573 | B2 * | 7/2022 | Yamazaki | D21H 17/25 |
| 11,858,238 | B2 * | 1/2024 | Dani | C11D 17/041 |
| 12,037,747 | B2 * | 7/2024 | Kanamaru | A47L 13/17 |
| 2011/0290437 | A1 * | 12/2011 | Vogel | D21H 17/20 162/158 |
| 2016/0177512 | A1 * | 6/2016 | Kawahara | C12M 23/20 162/158 |
| 2019/0246863 | A1 * | 8/2019 | Mukoyama | D21H 17/70 |
| 2019/0276958 | A1 * | 9/2019 | Konishi | D04H 1/28 |
| 2021/0148053 | A1 * | 5/2021 | Yamazaki | D21H 27/002 |
| 2022/0282427 | A1 * | 9/2022 | Kanamaru | D21H 21/22 |
| 2023/0167608 | A1 * | 6/2023 | Kanamaru | D21H 25/02 162/158 |

FOREIGN PATENT DOCUMENTS

| | | | | | |
|---|---|---|---|---|---|
| EP | 3915455 | A1 * | 12/2021 | | A47L 13/17 |
| EP | 4137637 | A1 * | 2/2023 | | A47K 11/105 |
| JP | 2001234457 | A * | 8/2001 | | |
| JP | 2006181764 | A * | 7/2006 | | |
| JP | 2006-307384 | A | 11/2006 | | |
| JP | 2008002017 | A | 1/2008 | | |
| JP | 2008-45108 | A | 2/2008 | | |
| JP | 2008-101283 | A | 5/2008 | | |
| JP | 2016-084565 | A | 5/2016 | | |
| JP | 2016-194164 | A | 11/2016 | | |
| JP | 6211160 | B1 * | 10/2017 | | A47K 10/16 |
| JP | 2018121690 | A | 8/2018 | | |
| JP | 2021055215 | A * | 4/2021 | | A47L 13/17 |
| JP | 2024013396 | A * | 2/2024 | | |
| KR | 20170132155 | A * | 12/2017 | | A47K 10/16 |
| KR | 20180012750 | A * | 2/2018 | | D21H 27/00 |
| WO | 2016/159145 | A1 | 10/2016 | | |
| WO | WO-2018158724 | A1 * | 9/2018 | | B08B 1/006 |
| WO | WO-2020153128 | A1 * | 7/2020 | | A47L 13/17 |
| WO | WO-2021241205 | A1 * | 12/2021 | | A47K 11/105 |

OTHER PUBLICATIONS

Erdman et al., in "Estimation of Fibre Orientation in Paper Products by an Image Analysis On-Line." Fibres a & textiles in eastern Europe 24 2(116), aphes 107-112. (Year: 2016).*
International Preliminary Report on Patentablity issued Nov. 17, 2022, in corresponding International Application No. PCT/JP2021/017882, 9 pages.
International Search Report and Written Opinion issued on Jul. 20, 2021 in corresponding Application No. PCT/JP2021/017882, 14 pgs.
Office Action issued on Oct. 26, 2021 in corresponding Japanese Application No. 2020-094077, 7 pgs.
Extended Search Report issued on Sep. 11, 2023, in corresponding European Application No. 21813142.3, 7 pages.
Office Action issued on Dec. 1, 2023, in corresponding Chinese Application No. 202180030166.6, 12 pages.
Office Action issued on Apr. 4, 2024, in corresponding Chinese Application No. 202180030166.6, 10 pages.
Office Action issued on Jun. 28, 2024, in corresponding Chinese Application No. 202180030166.6, 12 pages.

* cited by examiner

WATER DISPERSIBLE SHEET AND METHOD TO MANUFACTURE WATER DISPERSIBLE SHEET

FIELD

The present invention relates to a water dispersible sheet and a method to manufacture the water dispersible sheet.

BACKGROUND

In general, a toilet cleaning sheet, which is a water dispersible sheet, has surface strength so as not to tear when a toilet bowl is scrubbed with it, and a water dispersing property so as to be discarded as it is in water collected in the toilet bowl and to be flushed after completion of cleaning (see, for example, JP 2016-084565 A).

SUMMARY

However, in a step for making paper for a conventional toilet cleaning sheet, fibers are covered over a wire of a paper making device and the fibers are sent in a conveying direction. With this, most of the fibers are aligned in a longitudinal direction which is the conveying direction of the paper making device, and fiber density in a transverse direction becomes thin. Therefore, there is a problem that the fibers tend to snap when wiping is performed in the transverse direction, and the sheet is torn.

The present invention has been made in consideration of the above problems, and the purpose is to provide a water dispersible sheet with excellent balance in the strength between the longitudinal direction and the transverse direction, and a method to manufacture such water dispersible sheet.

In order to achieve the object, according to the invention recited in aspect 1, there is provided a water dispersible sheet including: a base paper sheet including a water dispersible fiber aggregate wherein the base paper sheet is impregnated with a chemical solution, wherein the fiber aggregate includes 50% by mass to 70% by mass of NBKP, wherein the water dispersible sheet includes a longitudinal/transverse strength ratio of 0.9 to 1.2, and wherein emboss is formed on the water dispersible sheet.

According to the invention recited in aspect 2, the water dispersible sheet according to aspect 1, wherein a water-soluble binder that is not more than 5% of a weight of the base paper sheet is added.

According to the invention recited in aspect 3, the water dispersible sheet according to aspect 1 or 2, wherein 20 $g/m^2$ to 60 $g/m^2$ of propylene glycol monomethyl ether is added to the water dispersible sheet.

According to the invention recited in aspect 4, the water dispersible sheet according to any one of aspects 1 to 3 wherein 5 $g/m^2$ to 30 $g/m^2$ of diethylene glycol monobutyl ether is added to the water dispersible sheet.

According to the invention recited in aspect 5, a manufacturing method to manufacture the water dispersible sheet may include generating a base paper sheet with a longitudinal/transverse strength ratio of 0.6 to 0.8 from a fiber aggregate; applying a water-soluble binder in the base paper sheet; heat-drying the base paper sheet; embossing the base paper sheet; and impregnating the base paper sheet with a chemical solution, wherein the longitudinal/transverse strength ratio of the water dispersible sheet after embossing and impregnating with the chemical solution is 0.9 to 1.2.

According to the present invention, it is possible to provide a water dispersible sheet with excellent balance in the strength between the longitudinal direction and the transverse direction, and a method to manufacture such water dispersible sheet.

DETAILED DESCRIPTION

Hereinafter, with reference to FIG. 1 to FIG. 4B, the toilet cleaning sheet as a water dispersible sheet, which is an embodiment of the present invention, will be described in detail. However, the scope of the invention is not limited to the illustrated examples.

A toilet cleaning sheet will be described as an example of the water dispersible sheet, but the water dispersible sheet also includes a wet tissue impregnated with a chemical solution for use in wiping.

Figure 1:
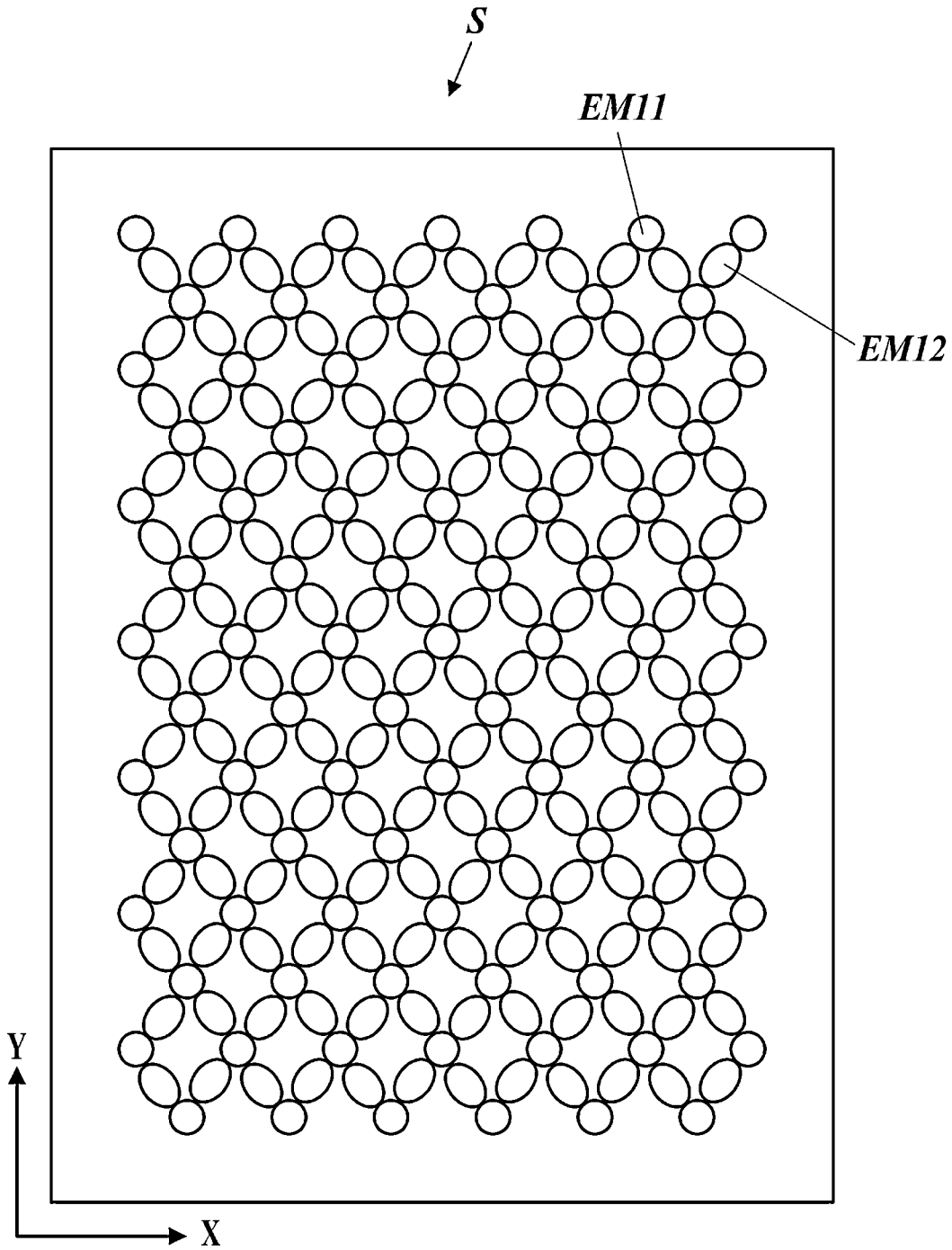
FIG. 1 is a plan view showing an example of a toilet cleaning sheet according to the present embodiment.
Figure 2A:
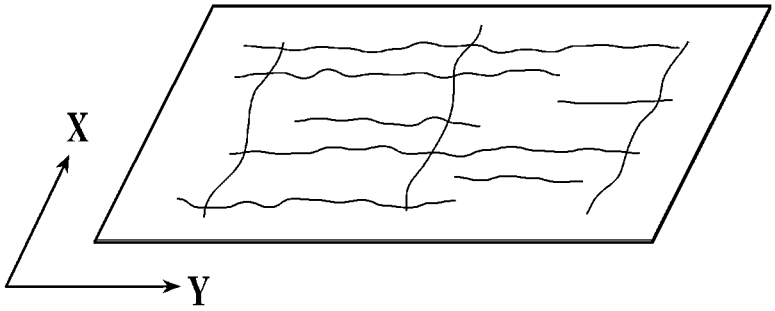
FIG. 2A is a view showing fiber orientation of a conventional sheet.
Figure 2B:
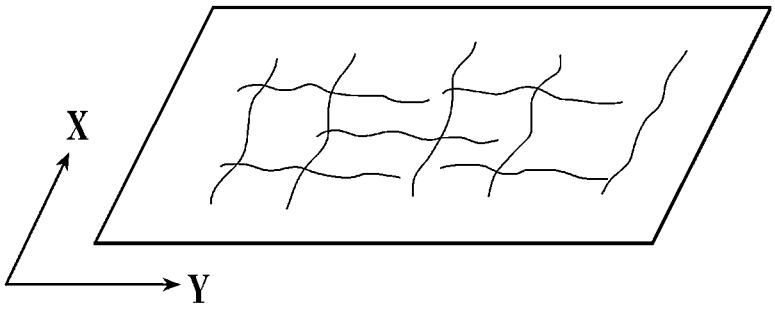
FIG. 2B is a view showing fiber orientation according to the present invention.

For convenience, X, Y, up and down, and left and right directions are defined as shown in FIG. 1, FIG. 2A, and FIG. 2B.

[Overall Structure]

The toilet cleaning sheet S of the present invention is a sheet in which base paper sheets are subjected to ply processing (stacked) and is preferably a toilet cleaning sheet of a wet type that is impregnated with a predetermined chemical solution.

The base paper sheet is preferably made by ply processing of two base paper sheets, because when it is made by ply processing of three or more base paper sheets, CMC described later is applied in a spotty manner.

The base paper sheet may also be composed of a single base paper sheet, without ply processing.

The surface of the toilet cleaning sheet S is embossed. For example, two types of embosses EM11 and EM12 are provided as shown in FIG. 1.

The basis weight of the base paper sheet per sheet is about 30 to 150 $g/m^2$. The basis weight is based on JIS P 8124.

The base paper sheet of the toilet cleaning sheet S according to the present embodiment is configured with a water dispersible fiber aggregate so as to be discarded in the water collected in the toilet bowl as it is after cleaning the toilet bowl and the like.

[Fiber Aggregate]

The fiber aggregate is not particularly limited as long as it has a water dispersing property, but a single layer or multiple layers of paper or nonwoven fabric can be suitably used. The fiber raw material may be a natural fiber or a synthetic fiber, and they may be mixed. Suitable fiber raw materials include cellulosic fibers such as wood pulp, non-wood pulp, rayon, and cotton, biodegradable fibers made of polylactic acid, and the like. In addition, with these fibers as a main component, polyethylene fibers, polypropylene fibers, polyvinyl alcohol fibers, polyester fibers, polyacrylonitrile fibers, synthetic pulp, glass wool, and the like may be used in combination.

In particular, a fiber aggregate containing at least pulp is preferable, and suitable pulp to be used as a raw material is leaf bleached kraft pulp (LBKP) and needle bleached kraft pulp (NBKP) blended in an appropriate ratio.

The blended ratio of the needle bleached kraft pulp is preferably 50% by mass to 70% by mass, more preferably 65% by mass. By making the blended ratio of the needle bleached kraft pulp higher with relation to the leaf bleached kraft pulp, an adjustment can be made so that the difference in the longitudinal/transverse strength in the toilet cleaning sheet S is smaller. By making the blended ratio of the needle bleached kraft pulp 70% by mass or smaller, the gap between the fibers does not become too large, and the chemical solution drying from the toilet cleaning sheet S becomes difficult to a sufficient level.

Further, the base paper sheet may be configured of a sheet made of crushed pulp or a sheet of crushed pulp covered or sandwiched with a water dispersible sheet(s).

[Water-Soluble Binder]

A water-soluble binder for enhancing paper strength is applied to the base paper sheet of the toilet cleaning sheet S. Examples of the water-soluble binder include a binder component such as carboxymethyl cellulose, polyvinyl alcohol, starch or a derivative thereof, hydroxypropyl cellulose, sodium alginate, trant gum, guar gum, xanthan gum, gum arabic, carrageenan, galactomannan, gelatin, casein, albumin, purplan, polyethylene oxide, viscose, polyvinyl ethyl ether, sodium polyacrylate, sodium polymethacrylate, polyacrylamide, hydroxylated derivatives of polyacrylic acid, polyvinyl pyrrolidone/vinyl pyrrolidone vinyl acetate copolymer, and the like.

In particular, from the viewpoint of a good water dispersing property and the possibility of developing wet strength by cross-linking reaction, a water-soluble binder having a carboxyl group is preferably used.

The water-soluble binder having a carboxyl group is an anionic water-soluble binder which readily generates carboxylate in water. Examples thereof include polysaccharide derivatives, synthetic polymers, and natural products.

(Polysaccharide Derivative)

Examples of the polysaccharide derivative include a salt of carboxymethyl cellulose, carboxyethyl cellulose or a salt thereof, and carboxymethylated starch or a salt thereof, and an alkali metal salt of carboxymethyl cellulose (CMC) is particularly preferable.

(CMC)

It is desirable that CMC has an etherification degree of 0.6 to 2.0, particularly 0.9 to 1.8, more preferably 1.0 to 1.5. This is because the water dispersing property and the development of wet paper strength become extremely good.

It is preferable to use water-swellable CMC. This exerts a function of linking the fibers constituting the base paper sheet while remaining unswollen by forming cross-links with a specific metal ion as the cross-linking agent in the chemical solution, so that strength as a durable toilet wiping sheet in cleaning/wiping is exhibited.

In the present embodiment, CMC is applied to the toilet cleaning sheet S as the water-soluble binder.

The base paper sheet may be uniformly impregnated with CMC in the thickness direction, but is preferably impregnated with CMC such that the content of CMC in the base paper sheet gradually increases from the center in the thickness direction toward the front face and the back face. As a result, if the toilet cleaning sheet S is used for rubbing the rim of a toilet bowl strongly, the toilet cleaning sheet S is less likely to be torn compared with a conventional product which is uniformly impregnated with the water-soluble binder of the same amount.

The added amount of the CMC which is the water-soluble binder is preferably 5% or less with relation to the weight of the base paper sheet. Consequently, both strength of the toilet cleaning sheet S in dealing with water stains and water dispersing properties of the toilet cleaning sheet S can be achieved.

(Synthetic Polymer)

Examples of the synthetic polymers include a salt of a polymer or a copolymer of an unsaturated carboxylic acid, a salt of a copolymer of an unsaturated carboxylic acid and a monomer copolymerizable with the unsaturated carboxylic acid, and the like. Examples of the unsaturated carboxylic acid include acrylic acid, methacrylic acid, itaconic acid, crotonic acid, maleic anhydride, maleic acid, fumaric acid, and the like. Examples of the monomer copolymerizable with them include esters of these unsaturated carboxylic acids, vinyl acetate, ethylene, acrylamide, vinyl ether, and the like. A particularly preferred synthetic polymer is one using acrylic acid or methacrylic acid as the unsaturated carboxylic acid, and specifically include salts of polyacrylic acid, polymethacrylic acid, or acrylic acid methacrylic acid copolymer, and salts of a copolymer of acrylic acid or methacrylic acid, an alkyl acrylate or alkyl methacrylate.

Examples of natural products include sodium alginate, xanthan gum, gellan gum, Tragacanth gum, pectin, and the like.

(CNF)

Cellulose nanofibers (hereinafter referred to as CNF) can be added to the toilet cleaning sheet S.

That is, CNF can be added to the water-soluble binder (CMC in the present embodiment), and the specific surface area of the base paper sheet is larger than that with pulp-only composition.

CNF refers to fine cellulose fibers obtained by fibrillating pulp fibers. In general, CNF refers to cellulose fibers containing cellulose fine fibers having a fiber width of nano-order size (1 nm or more and 1000 nm or less). An average fiber width is preferably 100 nm or less. Number average, median, mode diameter (mode) and the like from a certain number of fibers are used to calculate the average fiber width.

The base paper sheet may be uniformly impregnated with CNF in the thickness direction, but is preferably impregnated with CNF such that the content of CNF in the base paper sheet gradually increases from the center in the thickness direction toward the front face and the back face. As a result, even when the toilet cleaning sheet S is used for rubbing the rim of a toilet bowl strongly, the toilet cleaning sheet S is less likely to be torn compared with a conventional product that is uniformly impregnated with the water-soluble binder of the same amount.

(Pulp Fiber Usable for CNF)

Examples of pulp fibers usable for the production of CNF include chemical pulp such as broad leaf tree pulp (LBKP) and needle leaf tree pulp (NBKP); mechanical pulp such as bleaching thermomechanical pulp (BTMP), stone ground pulp (SGP), pressurized stone ground pulp (PGW), refiner ground pulp (RGP), chemi-ground pulp (CGP), thermograng pulp (TGP), grand pulp (GP), thermomechanical pulp (TMP), chemi-thereto mechanical pulp (CTMP), and refiner mechanical pulp (RMP); used paper pulp manufactured from Kraft waste paper, Kraft envelope waste paper, magazine waste paper, newspaper waste paper, leaflets waste paper, office waste paper, cardboard waste paper, high quality white waste paper, Kent waste paper, simili waste paper, cardboard waste paper, and woody waste paper; and deinked pulp (DIP) made by deinking used paper pulp. As long as the effects of the present invention are not impaired, these may be used alone or in combination of multiple types.

(Fibrillation Methods of CNF)

Fibrillation methods used for producing CNF are not limited to, but include, for example, mechanical methods such as a high pressure homogenizer method, a microfluidizer method, a grinder grinding method, a bead mill freeze pulverization method, and an ultrasonic fibrillating method.

CNF that has been only mechanically treated by the above fibrillation methods (CNF without modification), namely, CNF that has been subjected to no modification with functional groups, has higher thermal stability and therefore can be used in a wider range of applications than CNF that has been subjected to modification with functional groups such as phosphate groups and carboxymethyl groups. However, CNF that has been subjected to modification with functional groups such as phosphate groups and carboxymethyl groups can also be used in the present invention.

Alternatively, for example, the pulp fiber may be mechanically treated by the fibrillation methods, and then chemically treated by carboxymethylation, or enzymatically treated. Chemically treated CNF include, for example, iCNF (individualized CNF) (single nanocellulose) having a diameter of 3 to 4 nm, such as TEMPO-oxidized CNF, phosphate esterified CNF, and phosphite esterified CNF.

Alternatively, CNF treated only chemically or enzymatically, or CNF treated chemically or enzymatically and then treated mechanically by the fibrillation process may be used.

[Longitudinal/Transverse Tensile Strength Ratio]

The ratio of the tensile strength in the longitudinal and the transverse directions of the toilet cleaning sheet S (longitudinal/transverse) is 0.9 to 1.2 and preferably close to 1.0.

In the papermaking step which is a step for producing paper, since fibers are spread over wire(s) of a papermaking machine and flows in the conveying direction, many fibers are generally aligned in the longitudinal direction, which is the conveying direction of the papermaking machine (for example, longitudinal:transverse=2.3:1, refer to FIG. 2A), in the paper. Therefore, the fiber density in the transverse direction is low so that the fiber tends to break. That is, it tends to be torn depending on the wiping direction. Therefore, in the present embodiment, as shown in FIG. 2B, the tensile strength ratio in the longitudinal and transverse directions of the toilet cleaning sheet S is adjusted to 0.9 to 1.2. As a result, it is possible to provide the toilet cleaning sheet S which is hard to be torn even by wiping with it in any direction. The ratio of the tensile strength in the longitudinal and the transverse directions can be obtained from the ratio of the wet strengths in the directions of MD (Machine Direction) and CD (Cross Direction).

(Dry Tensile Strength)

Preferably, in the toilet cleaning sheet S, the longitudinal/transverse ratio of dry tensile strength of the base paper sheet defined in JIS P 8113 (2006) is 0.6 to 0.8. This longitudinal/transverse ratio can be adjusted by changing various paper making conditions such as a jet wire ratio in the wire part. By providing a difference in the longitudinal/transverse ratio of the dry tensile strength (longitudinal direction/transverse direction), the difference in the longitudinal direction/transverse ratio can be made small when embossing is provided.

[Chemical Solution]

The toilet cleaning sheet S of the present embodiment is impregnated with a predetermined chemical solution containing the cross-linking agent that forms cross-links with the water-soluble binder (CMC in the case of the toilet cleaning sheet S of the present embodiment). In addition to this, the chemical solution contains an auxiliary agent such as glycol ethers, an aqueous detergent, an antiseptic, a disinfectant, an organic solvent, and the like.

After impregnated with the water-soluble binder and then dried, the base paper sheet is impregnated with the chemical solution.

The toilet cleaning sheet S is impregnated with the chemical solution of 100 to 500% by mass, preferably 150 to 300% by mass, relative to the mass of the base paper sheet as the base material of the toilet cleaning sheet S.

(Cross-Linking Agent)

As the cross-linking agent, boric acid, various metal ions and the like can be used, but when CMC is used as the water-soluble binder, a polyvalent metal ion is preferably used. In particular, it is preferable to use one or more of polyvalent metal ions selected from a group consisting of alkaline earth metals, manganese, zinc, cobalt, and nickel, from the viewpoint of developing wet strength for durability in use by sufficiently bonding the fibers and from the viewpoint of improving the sufficient water dispersing property. Among these metal ions, ions of calcium, strontium, barium, zinc, cobalt, or nickel are used particularly preferably.

(Glycol Ethers)

Glycol ethers have a structure in which a hydroxyl group at one or both ends of glycol, a divalent alcohol, is etherified, and are a compound including a hydrophobic alkyl group and a hydrophilic ether group and hydroxy group in the molecule. Glycol ethers have a lower molecular weight than surfactants and leads to a lower dynamic surface tension than conventional detergents containing only surfactants. Therefore, an interface between the chemical solution and stain can be formed more quickly. Glycol ethers also function as a coupling agent to compatibilize hydrophobic oil or stain with water, and can pull off stain and prevent it from reattaching. Therefore, the addition of glycol ethers to the chemical solution can improve the wiping performance of the toilet cleaning sheet S.

The chemical solution of the present invention includes glycol ethers such as: propylene glycol monomethyl ether (PGME), diethylene glycol monobutyl ether (DGME), ethylene glycol monomethyl ether, diethylene glycol monomethyl ether, triethylene glycol monomethyl ether, polyethylene glycol monomethyl ether, ethylene glycol isopropyl ether, diethylene glycol monoisopropyl ether, triethylene glycol monomethyl ether, polyethylene glycol monomethyl ether, ethylene glycol isopropyl ether, diethylene glycol monoisopropyl ether, and ethylene glycol monobutyl ether.

In particular, PGME, which is usually added as a detergent ingredient and is known to improve detergency, exhibits an effect of directly improving the sheet strength, and has an effect of enhancing the sheet strength improving effect due to the CMC and the polyvalent metal ion. As a result, a high deodorizing effect is considered to be exhibited. The amount of PGME to be added is preferably 20 to 60 g/m$^2$, more preferably 26 to 40 g/m$^2$. When the amount is less than 20 g/m$^2$, the deodorant effect is not sufficiently obtained. Even when the amount is more than 60 g/m$^2$, the obtained deodorant effect is not more than that when the amount is 60 g/m$^2$.

DGME is an auxiliary agent similar to PGME in that it has an effect of improving sheet strength. The amount of DGME to be added is preferably 5 to 30 g/m$^2$, more preferably 10 to 20 g/m$^2$.

However, when only DGME, which can improve the sheet strength most effectively, is added, sebum on the user's hands may be wiped off, which may cause hand roughness. Therefore, in order to improve the sheet strength while preventing hand roughness, glycol ethers such as PGME need to be formulated appropriately into the chemical solution in addition to DGME.

(Aqueous Detergent)

As the aqueous detergent, for example, lower or higher (aliphatic) alcohol can be used in addition to a surfactant.

(Antiseptic)

As the antiseptic, for example, parabens such as methylparaben, ethylparaben, propylparaben, and the like can used.

(Disinfectant)

As the disinfectant, for example, benzalkonium chloride, chlorhexidine gluconate, povidone iodine, ethanol, benzalkonium cetyl phosphate, triclosan, chloroxylenol, isopropylmethylphenol, and the like can used. As the organic solvent, polyhydric alcohols such as glycol (divalent), glycerin (trivalent), sorbitol (tetravalent), and the like can used.

Further, the auxiliary agent of the above-mentioned components of the chemical solution can be selected appropriately, and a component which fulfills other functions may be contained in the chemical solution as necessary. For example, propylene glycol (PG) can be used as an auxiliary agent to solubilize the antiseptic and the disinfectant.

[Emboss]

Embossing is performed on the surface of the toilet cleaning sheet S. In the case of the toilet cleaning sheet S, for example, as shown in FIG. 1, two types of embosses EM11 and EM12 are embossed on it.

Although the shape, number, area ratio, and the like of the embosses are optional, in the case of the toilet cleaning sheet S, the embosses EM11 are arranged so as to form a diamond lattice. As a result, uneven wiping can be reduced as compared with the case where the embosses EM11 are arranged to form a square lattice or a rectangular lattice. The embosses EM12 are arranged between the embosses EM11.

Figure 3A:
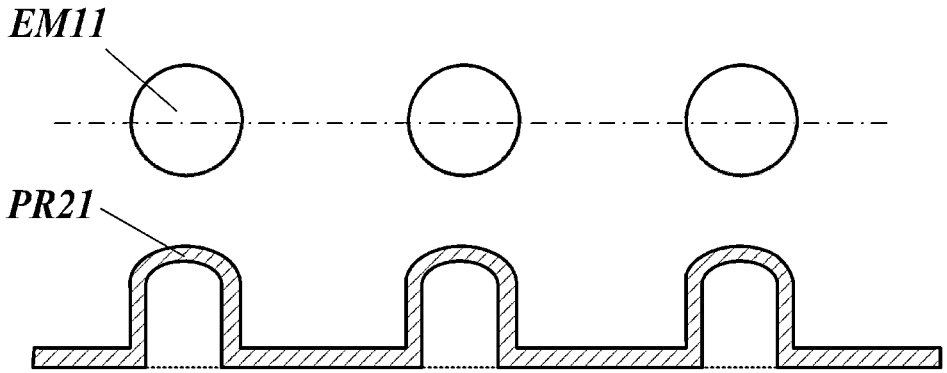
FIG. 3A is an enlarged view and a sectional view of one kind of emboss portions of the toilet cleaning sheet.

The embosses EM11 each have, as shown in FIG. 3A, a protrusion PR21 having a curved shape.

Figure 3B:
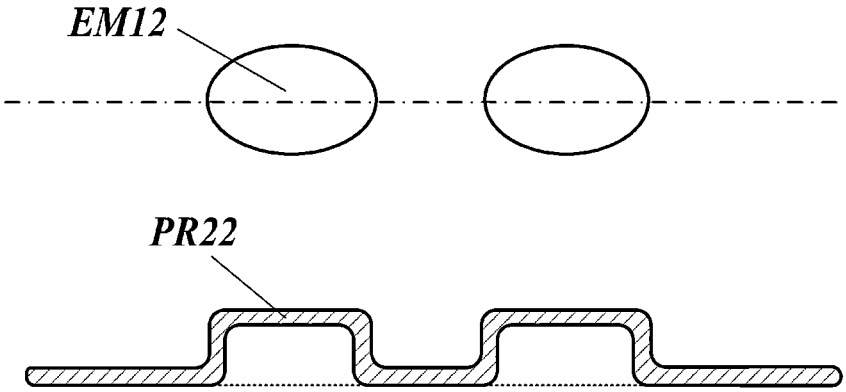
FIG. 3B is an enlarged view and a sectional view of the other kind of emboss portions of the toilet cleaning sheet.

The embosses EM12 each have, as shown in FIG. 3B, a protrusion PR22 having a plane shape.

Figure 3C:
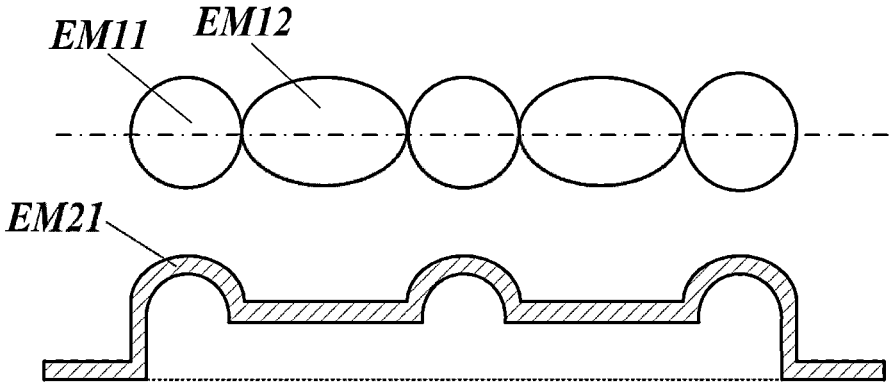
FIG. 3C is an enlarged view and a sectional view of a portion where the one kind of emboss portions and the other kind of emboss portions of the toilet cleaning sheet are close to each other.

Since the embosses EM12 are arranged between the embosses EM11, the protrusions PR21 of the embosses EM11 and the protrusions PR22 of the embosses EM12 are closely adhered to each other to form a continuous emboss EM21 as shown in FIG. 3C.

Alternatively, the protrusions PR21 of the embosses EM11 and the protrusions PR22 of the embosses EM12 may be only close to each other and do not have to be continuous.

By forming the two types of embosses EM11 and EM12 in this way, it is possible to increase contact areas with the object to be cleaned. As a result, the toilet cleaning sheet S becomes less stiff and has higher wiping property.

That is, by forming both the embosses EM11 whose protrusions PR21 each have a curved surface and the embosses EM12 whose protrusions PR22 each have a plane surface on the entire surface of the toilet cleaning sheet S, the respective embosses are deformed and the contact areas increase for the first time when a force is applied to the toilet cleaning sheet S during the wiping operation. Therefore, as well as increasing the contact areas, flexibility is also improved due to deformation of the respective embosses.

Figure 4A:
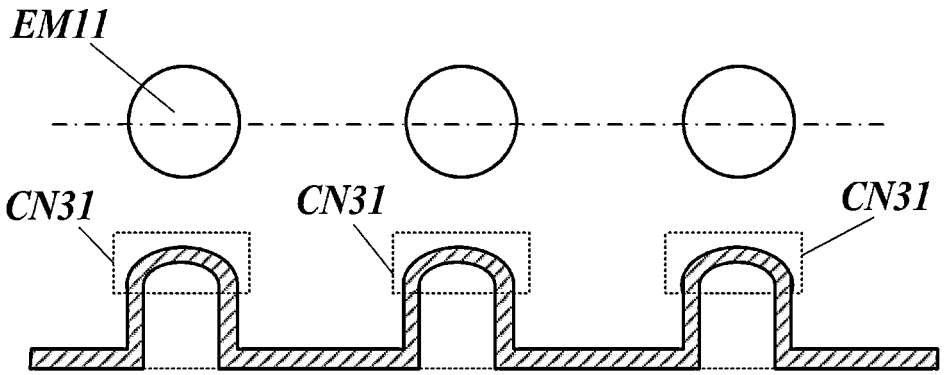
FIG. 4A is an explanatory view showing an example of a contact area of the one kind of embosses.
Figure 4B:
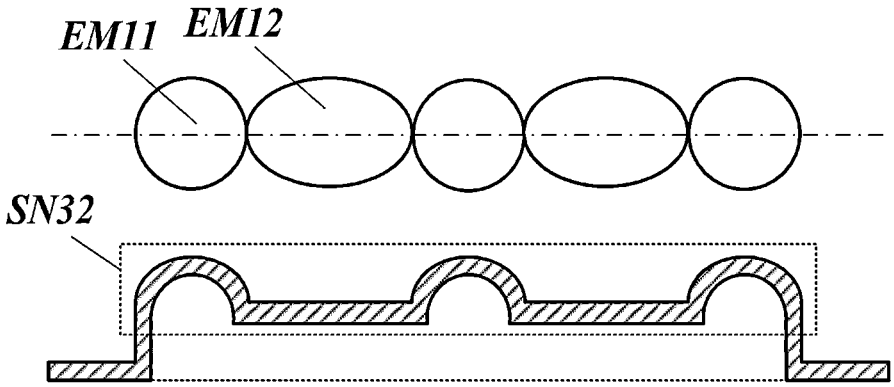
FIG. 4B is an explanatory view showing an example of a contact area of the portion where the one kind of emboss portions and the other kind of emboss portions are close to each other.

For example, as shown in FIG. 4A, if there is a single type of embosses EM11, the contact areas CN31 after deformation of the embosses EM11 due to the force applied to the toilet cleaning sheet S during the wiping operation are generated discretely in the vicinity of the respective embosses EM11. On the other hand, if there are two types of embosses EM11 and EM12 in combination, as shown in FIG. 4B, the contact areas SN32 after deformation of the embosses EM11 and EM12 due to the force applied to the toilet cleaning sheet S during the wiping operation are increased as compared with the contact area CN31 of FIG. 4A.

Further, the two types of the embosses EM11 and EM12 also exhibit the effect of normal embosses, and it is possible to improve the texture, absorbency, bulkiness, etc. of the toilet cleaning sheet S. Furthermore, as well as normal embosses, the continuous embosses EM21 also exhibit the effect of good appearance by embossing.

The toilet cleaning sheet S is folded in two at the center portion in the Y direction by a fold process. Then, it is stored in a plastic case for storage or in a packaging film in a folded state, and unfolded as necessary at the time of use. The way of folding the toilet cleaning sheet S is not limited to folding in two, but may be folding in four or eight, for example.

EXAMPLE

Next, results of evaluating preferable configurations to improve longitudinal/transverse strength ratio and surface strength are described regarding the example and the comparative examples of the present invention. Below, the present invention is specifically described by the examples, but the present invention is not limited to these examples.

The CMC included in a binder solution of the example and the comparative examples described below are CMC 1330 (Daicel). The DGME in the chemical solution is a linear compound.

[Sample Preparation for Tests 1-4]

Raw material for making paper blended in the ratio of 40% by mass of NBKP and 60% by mass of LBKP and raw material for making paper blended in the ratio of 65% by mass of NBKP and 35% by mass of LBKP are prepared.

Next, paper is made under the conditions described in example 1 and comparative examples 1-3 while adjusting a jet wire ratio. After making a base paper sheet that is targeted 86 g/m2, ply processing is performed to make two plies.

The conditions of the example 1 and the comparative examples 1-3 are described below.

Example 1

The raw material for paper making blended in a ratio of 65% by mass of NBKP and 35% by mass of LBKP is adjusted to make paper so that a drying strength of the base paper sheet becomes MD/CD=0.6.

Comparative Example 1

The raw material for paper making blended in a ratio of 40% by mass of NBKP and 60% by mass of LBKP is adjusted to make paper so that a drying strength of the base paper sheet becomes MD/CD=1.2.

Comparative Example 2

The raw material for paper making blended in a ratio of 40% by mass of NBKP and 60% by mass of LBKP is adjusted to make paper so that a drying strength of the base paper sheet becomes MD/CD=1.0.

Comparative Example 3

The raw material for paper making blended in a ratio of 65% by mass of NBKP and 35% by mass of LBKP is adjusted to make paper so that a drying strength of the base paper sheet becomes MD/CD=1.0.

The following tests 1-4 were performed using base paper sheets made under the conditions of the example 1 and the comparative examples 1-3.

[Test 1. Tensile Strength Test when Dry]

Each base paper sheet is cut in a width of 25 mm to form a sheet for the tests. Each end of the test sheet is held with a chuck in a tensile testing machine (TENSIRON RTG1210 manufactured by A&D). A maximum load point when the plies of the base paper sheets are peeled at adhered locations is measured under the conditions of the distance between the chucks being 50 mm and the speed being 500 mm/min. Such test is performed 4 times for each test sheet in the MD direction and the CD direction. With this, an average value of the tensile strength and an average value of longitudinal/transverse strength ratio are calculated.

[Test 2. Tensile Strength Test When Wet (Without Embossing)]

By using water soluble binder applying equipment, the binder solution including 96 percent water and 4 percent CMC is applied by spraying 1.4% by mass at dry weight on an outer surface of each base paper sheet.

Next, the sheet is passed through a hot air dryer (temperature 180°) until the sheet is dried so that moisture contents is approximately 8 percent.

Next, the sheet is impregnated with the chemical solution blended at a ratio of 4.050% by mass of cross-linking agent, 0.200% by mass of aqueous detergent, 0.205% by mass of antiseptic, 0.200% by mass of disinfectant, 3.000% by mass of PG, 16.5% by mass of PGME, and 75.845% by mass of purified water in an amount of 200% by mass, and the test sheets for the example 1 and the comparative examples 1-3 are made.

Next, the test the same as the test 1 is performed 4 times for each test sheet. With this, the average value of the tensile strength and the average value of the longitudinal/transverse strength ratio are calculated.

[Test 3. Tensile Strength Test when Wet (with Embossing)]

In test 2, the sheets are embossed as shown in FIG. 1 with embossing processing equipment after heat drying, and the sheet is impregnated with the chemical solution. With this, the test sheets for the example 1, and the comparative examples 1-3 are made.

Next, the test the same as the test 1 is performed 4 times for each test sheet. With this, the average value of the tensile strength and the longitudinal/transverse strength ratio are calculated.

The results of the tests are shown in Table I.

TABLE I

| | | | | COMPARATIVE EXAMPLE 1 | COMPARATIVE EXAMPLE 2 | COMPARATIVE EXAMPLE 3 | EXAMPLE 1 |
|---|---|---|---|---|---|---|---|
| | | PULP (% BY MASS) | NBKP | 40 | 40 | 65 | 65 |
| | | | LBKP | 60 | 60 | 35 | 35 |
| | | PAPER DENSITY ($g/m^2$) | | 86 | 86 | 86 | 86 |
| DRY BASE PAPER | 1 PLY | BASE PAPER DRY STRENGTH ($cN/m^2$) | MD | 2,973 | 2,768 | 1,964 | 1,825 |
| | | | CD | 2,570 | 2,683 | 1,904 | 2,838 |
| | | | MD/CD | 1.2 | 1.0 | 1.0 | 0.6 |
| | 2 PLY | BASE PAPER DRY STRENGTH ($cN/m^2$) (TEST 1) | MD | 5,430 | 5,261 | 3,633 | 3,377 |
| | | | CD | 4,115 | 4,316 | 3,046 | 4,541 |
| | | | MD/CD | 1.3 | 1.2 | 1.2 | 0.7 |
| IMPREGNATED WITH CHEMICAL LIQUID | WATER-SOLUBLE BINDER | | CMC ADDITIVE AMOUNT (% BY MASS) | 1.4 | 1.4 | 1.4 | 1.4 |
| | NOT EMBOSSED 2 PLY | WET STRENGTH ($cN/m^2$) (TEST 2) | MD | 773 | 746 | 718 | 593 |
| | | | CD | 669 | 594 | 529 | 831 |
| | | | MD/CD | 1.2 | 1.3 | 1.4 | 0.7 |
| | EMBOSSED 2 PLY | WET STRENGTH ($cN/m^2$) (TEST 3) | MD | 618 | 597 | 574 | 474 |
| | | | CD | 368 | 327 | 291 | 457 |
| | | | MD/CD | 1.7 | 1.8 | 2.0 | 1.0 |

[Evaluation]

Comparing the results of the test 2 and the test 3, in both the comparative examples and the example, the longitudinal/transverse strength ratio greatly changes when the emboss processing is performed.

Therefore, as shown in comparative examples 1-3, instead of forming the base paper sheet with the longitudinal/transverse strength ratio at 1.0 in the dry state, the range is to be 0.6 to 0.8 as shown in example 1. Consequently, the longitudinal/transverse strength ratio of the toilet cleaning sheet S in which emboss processing is performed can be within the range of 0.9 to 1.2. As a result, it is possible to achieve the toilet cleaning sheet S with the longitudinal/transverse strength ratio that has excellent balance.

Moreover, it is possible to understand from the result of comparing the comparative example 3 and the example 1 that by not simply forming the base paper sheet from raw material for making paper with 65% by mass of NBKP and 35% by mass of LBKP, but also adjusting the dry tensile strength ratio in the paper making step to be 0.6 to 0.8, it is possible to generate the toilet cleaning sheet S with the longitudinal/transverse strength ratio that has excellent balance.

[Sample Preparation for Test 4]

By using water soluble binder applying equipment, the binder solution including 96 percent water and 4 percent CMC is applied by spraying 1.4% by mass at dry weight on an outer surface of base paper sheets for the example 1 and the comparative example 2.

Next, the sheet is passed through a hot air dryer (temperature 180° C.) until the sheet is dried so that moisture contents is approximately 8 percent.

Next, the embossing is performed as shown in FIG. 1 with emboss processing equipment, and embossed sheets for the example 1 and the comparative example 2 are made.

Next, the embossed sheets for the example 1 and the comparative example 2 are each impregnated with the chemical solution blended at a ratio of 4.050% by mass of cross-linking agent, 0.200% by mass of aqueous detergent, 0.205% by mass of antiseptic, 0.200% by mass of disinfectant, 3.000% by mass of PG, 16.5% by mass of PGME, and 75.845% by mass of purified water in an amount of 200% by mass, and the test sheets for the example 1 and the comparative example 2 are made.

Also, the embossed sheets for the example 1 and the comparative example 2 are each impregnated with a chemical solution blended at a ratio of 4.050% by mass of cross-linking agent, 0.200% by mass of aqueous detergent, 0.205% by mass of antiseptic, 0.200% by mass of disinfectant, 3.000% by mass of PG, 13.5% by mass of PGME, 3.000% by mass of DGME and 75.845% by mass of purified water in an amount of 200% by mass, and the test sheets for the example 2 and the comparative example 4 are made.

[Test 4. Martindale Test]

Regarding abrasion resistance of the test sheets for examples 1 and 2 and comparative examples 2 and 4, assuming a surface to be cleaned that has obstacles such as protruding material on a back side of a toilet seat, an abrasion resistance test is performed according to procedures (1) to (3) described below in accordance with the Martindale method defined in JIS L 1096 E method (2010).

(1) The test sheet cut in a size with 38φ is set in a Martindale tester which is a friction tester manufactured by Groz-Beckert.

(2) A 9 kpa weight is placed on the friction tester and the friction tester is started. An urethane cushion (Wakisangyo, Co., Ltd., CN-001) attached to an acrylic plate that assumes bumps and edges of a toilet is rubbed against the test sheet. The movement of the tester is performed in a Lissajous.

(3) The state of damage of the test sheet is checked, and the number of times of rubbing is read when the sheet is completely torn.

The average value of the result of performing the above test 4 for 10 times for each test sheet is shown in table II.

TABLE II

| | | | | COMPARATIVE EXAMPLE 2 | COMPARATIVE EXAMPLE 4 | EXAMPLE 1 | EXAMPLE 2 |
|---|---|---|---|---|---|---|---|
| DRY BASE PAPER | 2 PLY | PULP (% BY MASS) | NBKP | 40 | 40 | 65 | 65 |
| | | | LBKP | 60 | 60 | 35 | 35 |
| | | PAPER DENSITY ($g/m^2$) | | 86 | 86 | 86 | 86 |
| | | BASE PAPER DRY STRENGTH ($cN/m^2$) | MD | 5,261 | 5,261 | 3,377 | 3,377 |
| | | | CD | 4,316 | 4,316 | 4,541 | 4,541 |
| | | | MD/CD | 1.2 | 1.2 | 0.7 | 0.7 |
| IMPREGNATED WITH CHEMICAL LIQUID | WATER-SOLUBLE BINDER | | CMC ADDITIVE AMOUNT (% BY MASS) | 1.4 | 1.4 | 1.4 | 1.4 |
| | EMBOSSED 2 PLY | CHEMICAL LIQUID | DGME (% BY MASS) | 0.0 | 3.5 | 0.0 | 3.5 |
| | | ABRASION RESISTANCE TEST (TEST 4) | NUMBER OF TIMES OF RUBBING (TIMES) | 15 | 19 | 27 | 37 |

Evaluation

Comparing the comparative example 2 and the comparative example 4 with the example 1 and the example 2, respectively, it is possible to understand that by blending DGME in the chemical solution, the number of times of rubbing that is necessary to completely tear the sheet increases, and the strength of the toilet cleaning sheet S is enhanced.

This is presumably because PGME tends to penetrate the entire paper, whereas the DGME tends to stay on the surface of the paper, and the surface strength becomes stronger when the DGME is blended.

Moreover, it is possible to understand from comparing the comparative example 2 with the example 1, and the comparative example 4 with the example 2 that by not simply forming the base paper sheet from raw material for making paper with 65% by mass of NBKP and 35% by mass of LBKP, but also adjusting the dry tensile strength ratio in the paper making step to be 0.6 to 0.8, the longitudinal/transverse strength difference when the emboss processing is performed reduces, and the toilet cleaning sheet S is less prone to tearing.

The present invention can be used to provide a water dispersible sheet with excellent balance in strength between a longitudinal direction and a transverse direction and a method to manufacture the water dispersible sheet.

REFERENCE SIGNS LIST

S toilet cleaning sheet (water dispersible sheet)
EM 11, 12, 21 embossed

The invention claimed is:

1. A multi-ply water dispersible sheet comprising:

a base paper sheet including a water dispersible fiber aggregate and a water-soluble binder, wherein the base paper sheet is impregnated with a chemical solution comprising a cross-linking agent, wherein the fiber aggregate includes 50% by mass to 70% by mass of NBKP, wherein the water dispersible sheet includes a longitudinal/transverse strength ratio of 0.9 to 1.2, and wherein emboss is formed on the water dispersible sheet;

wherein the base paper sheet has an arrangement of fibers such that, when dry and in the absence of the emboss, the base paper sheet longitudinal/transverse strength ratio would be 0.6 to 0.8.

2. The water dispersible sheet according to claim 1, wherein the water-soluble binder is not more than 5% of a weight of the base paper sheet.

3. The water dispersible sheet according to claim 1, wherein 20 g/m$^2$ to 60 g/m$^2$ of propylene glycol monomethyl ether is added to the water dispersible sheet.

4. The water dispersible sheet according to claim 1, wherein 5 g/m$^2$ to 30 g/m$^2$ of diethylene glycol monobutyl ether is added to the water dispersible sheet.

5. A manufacturing method to manufacture the water dispersible sheet according to claim 1, the method comprising:

generating a base paper sheet with a longitudinal/transverse strength ratio of 0.6 to 0.8 from a fiber aggregate;

applying a water-soluble binder in the base paper sheet;

heat-drying the base paper sheet;

embossing the base paper sheet; and impregnating the base paper sheet with a chemical solution, wherein the longitudinal/transverse strength ratio of the water dispersible sheet after embossing and impregnating with the chemical solution is 0.9 to 1.2.

* * * * *